US010274195B2

(12) United States Patent
Gankema et al.

(10) Patent No.: US 10,274,195 B2
(45) Date of Patent: Apr. 30, 2019

(54) AIR/GAS ADMITTANCE DEVICE FOR A COMBUSTION APPLIANCE

(71) Applicant: Honeywell International Inc., Morris Plains, NJ (US)

(72) Inventors: Erik Gankema, Roswinkel (NL); Milos Trenz, Domasov (CZ); Tieme de Jonge, Erica (NL); Frank van Prooijen, Sleen (NL); Jens Wubkes, Ter Apel (NL)

(73) Assignee: Honeywell International Inc., Morris Plains, NJ (US)

( * ) Notice: Subject to any disclaimer, the term of this patent is extended or adjusted under 35 U.S.C. 154(b) by 240 days.

(21) Appl. No.: 15/253,112

(22) Filed: Aug. 31, 2016

(65) Prior Publication Data

US 2018/0058689 A1 Mar. 1, 2018

(51) Int. Cl.

| | |
|---|---|
| ***F23N 1/02*** | (2006.01) |
| ***F23N 1/00*** | (2006.01) |
| ***F23L 17/00*** | (2006.01) |

(52) U.S. Cl.

CPC ..... *F23N 1/002* (2013.01); *F23L 17/005* (2013.01); *F23N 1/022* (2013.01); *F23N 2025/04* (2013.01); *F23N 2900/05181* (2013.01)

(58) Field of Classification Search

CPC ..... F23N 1/002; F23N 1/02; F23N 2025/04; F23N 2900/05181; F23L 17/005

USPC .... 431/90, 12, 281; 137/8, 7, 118.06, 87.04; 138/39, 40

See application file for complete search history.

(56) References Cited

U.S. PATENT DOCUMENTS

| | | | | |
|---|---|---|---|---|
| 2,440,329 A * | 4/1948 | Doble | 261/64.3 | |
| 2,648,499 A * | 8/1953 | Dana | F23N 1/02 236/26 R | |
| 3,299,940 A * | 1/1967 | Phillips | F23D 14/02 137/114 | |
| 3,741,710 A * | 6/1973 | Nelson | F23N 1/027 137/100 | |
| 4,385,887 A * | 5/1983 | Yamamoto | F23N 1/027 137/484.8 | |

(Continued)

FOREIGN PATENT DOCUMENTS

| | | | |
|---|---|---|---|
| DE | 3818363 A1 * 4/1989 | F23N 1/027 | |
| DE | 102005033611 B3 * 10/2006 | F23N 1/005 | |

(Continued)

OTHER PUBLICATIONS https://books.google.co.in/books?id=19DqCAAAQBAJ&pg=PA280&dq=turbulence+reduction . . . , "Aerothermodynamics in Combustors," IUTAM Symposium, Taipei Taiwan, 1991, Google E-Book summary, 1 page, Jul. 20, 2016.

(Continued)

*Primary Examiner* — Gregory L Huson
*Assistant Examiner* — Daniel E Namay

(57) ABSTRACT

An improved air/gas admittance device for a combustion appliance. The improved air/gas admittance device is configured to provide a more uniform gas and/or air flow. This may help reduce noise in pressure and/or flow sensor measurements that are used by a gas valve controller to control the air/fuel ratio to the combustion appliance, which may help improve the efficiency and/or emissions of the combustion appliance.

20 Claims, 6 Drawing Sheets

(56) References Cited

U.S. PATENT DOCUMENTS 5,122,053 A * 6/1992 Basten ..... F23C 7/00 236/15 BD
5,329,955 A * 7/1994 Gensler ..... B01F 3/028 137/100
5,401,162 A * 3/1995 Bonne ..... F23N 1/022 431/12
5,520,533 A * 5/1996 Vrolijk ..... F23N 1/027 137/100
5,980,835 A 11/1999 Porozni
5,990,798 A * 11/1999 Sakai ..... F23N 5/242 340/632
6,135,063 A * 10/2000 Welden ..... F22B 1/26 122/446
6,322,247 B1 11/2001 Bonne et al.
6,533,574 B1 * 3/2003 Pechoux ..... F23N 5/188 431/12
6,537,060 B2 * 3/2003 Vegter ..... F23N 1/002 431/12
6,561,791 B1 * 5/2003 Vrolijk ..... F23N 1/022 431/12
6,579,087 B1 * 6/2003 Vrolijk ..... F23N 1/022 431/12
6,655,207 B1 12/2003 Speldrich et al.
6,984,122 B2 * 1/2006 Sullivan ..... F23N 1/022 431/18
7,101,172 B2 * 9/2006 Jaeschke ..... F23N 3/08 126/110 R
7,146,961 B1 12/2006 Westcott
7,234,307 B2 6/2007 Arman et al.
7,922,481 B2 * 4/2011 Geiger ..... F23N 1/022 431/12
7,992,454 B2 8/2011 Purdy et al.
8,303,297 B2 * 11/2012 Tompkins ..... F23N 1/022 431/12
8,397,586 B2 3/2013 Sorenson et al.
8,500,320 B2 8/2013 Andresen et al.
8,512,035 B2 8/2013 Super
8,635,997 B2 1/2014 Schultz et al.
8,668,491 B2 3/2014 Praat et al.
8,753,109 B2 6/2014 Thiewes et al.
8,899,108 B2 12/2014 Speldrich et al.
8,950,272 B2 2/2015 Setescak
9,239,257 B2 1/2016 Olin
9,528,712 B2 * 12/2016 Caruso ..... F23D 14/60
9,951,951 B2 * 4/2018 Lovascio ..... F23N 1/002
2004/0106078 A1 * 6/2004 Goebel ..... F04D 29/4213 431/12
2004/0214118 A1 * 10/2004 Sullivan ..... F23N 1/022 431/12
2008/0318172 A1 * 12/2008 Geiger ..... F23N 1/022 431/12
2009/0274985 A1 * 11/2009 McKnight ..... F23C 6/045 431/36
2010/0146939 A1 6/2010 Sim et al.
2011/0033808 A1 * 2/2011 Geiger ..... F23N 1/022 431/12
2012/0058439 A1 * 3/2012 Munsterhuis ..... F23N 5/003 431/12
2012/0125311 A1 * 5/2012 Grammens ..... F23N 1/022 126/116 R
2013/0294192 A1 * 11/2013 Son ..... B01F 3/028 366/182.4
2014/0080075 A1 * 3/2014 Young ..... F23N 1/022 431/76
2015/0345784 A1 * 12/2015 Lee ..... F23D 14/60 431/89

FOREIGN PATENT DOCUMENTS

EP 1323966 A1 * 7/2003 ..... F16K 31/0675
EP 1510756 A1 * 3/2005 ..... F23D 14/60
EP 1626321 A1 * 2/2006 ..... F23D 14/60
EP 1882882 A2 * 1/2008 ..... F23K 5/007
EP 2014979 A2 * 1/2009 ..... F23D 14/04
EP 2048439 A1 * 4/2009 ..... F23D 14/36
EP 2119946 A1 * 11/2009 ..... F16K 1/223
GB 2327750 A * 2/1999 ..... F23N 5/242
JP 58224227 A * 12/1983 ..... F23N 1/022
JP 59212622 A * 12/1984 ..... F23N 1/022
JP 04064813 A * 2/1992
WO WO 2006000366 A1 * 1/2006 ..... F23N 1/022
WO WO 2006000367 A1 * 1/2006 ..... F23N 1/022

OTHER PUBLICATIONS http://musclecardiy.com/performance/engine-measuring-efi-inputs-best/, "Engine Measuring EFI Inputs-Best," 17 pages, printed Jul. 20, 2016.

Ragsdale et al., "Turbulent Coaxial Mixing of Dissimilar Gases at Nearly Equal Stream Velocities," Heat Transfer and Fluid Mechanics Institute, University of California, National Aeronautics and Space Administration, Technical Memorandum, 27 pages, Jun. 21-23, 1965.

* cited by examiner

AIR/GAS ADMITTANCE DEVICE FOR A COMBUSTION APPLIANCE

TECHNICAL FIELD

The present disclosure relates generally to systems and methods for admitting air and fuel to a burner of a combustion appliance, and more particularly to a device and method for delivering an accurate air/fuel ratio to a burner of a combustion appliance.

BACKGROUND

The air/fuel ratio used during the operation of a combustion appliance can affect the efficiency and emissions of the combustion appliance. Example combustion appliances include furnaces, water heaters, boilers, direct/in-direct make-up air heaters, power/jet burners and any other residential, commercial or industrial combustion appliance. In many cases, the flow of gas is adjusted to set the air/fuel ratio. This is often accomplished by modulating a gas valve to control the pressure and thus the flow of gas to the combustion appliance. In some cases, the gas valve is modulated based on signals from one or more pressure or flow sensors placed in the gas and/or air streams. In some cases, turbulent and/or otherwise non-uniform gas and/or air flows can introduce noise into the pressure or flow sensor signals, which can result in a non-uniform or otherwise non-optimal air/fuel ratio. This can reduce the efficiency and/or increase the emissions of the combustion appliance. What would be desirable is an improved air/gas admittance device that provides a more uniform gas and/or air flow to reduce sensor noise and thus improve the efficiency and/or emissions of a combustion appliance.

SUMMARY

The present disclosure relates generally to an improved air/gas admittance device that provides a more uniform gas and/or air flow to reduce sensor noise and thus improve the efficiency and/or emissions of a combustion appliance.

In one example, an illustrative air/gas admittance device for use with a combustion unit such as a combustion appliance may include a body having a side wall defining a passageway that extends from an air inlet to an air/gas outlet and a gas pipe having a side wall defining a passageway that extends from a gas inlet to a gas outlet. The side wall of the body may have a gas pipe opening that is in fluid communication with the gas outlet of the gas pipe. An air flow restrictor may be positioned in the body between the gas pipe opening and the air inlet, and a gas flow restrictor may be positioned in the gas pipe downstream of the gas inlet. A first pressure port may be in the side wall of the body, upstream of the gas pipe opening. The first pressure port may be configured to be operatively coupled to a first pressure sensor for measuring a pressure of air within the body. A second pressure port may be in the side wall of the gas pipe. The second pressure port may be configured to be operatively coupled to a second pressure sensor for measuring a pressure of gas within the gas pipe. An air flow smoothing insert may be positioned in the body upstream of the first pressure port.

In another example, an air/gas admittance device for use with a combustion unit may comprise a body having a side wall defining a passageway that extends from an air inlet to an air/gas outlet and a gas pipe having a side wall defining a passageway that extends from a gas inlet to a gas outlet. The side wall of the body may have a gas pipe opening that is in fluid communication with the gas outlet of the gas pipe. An air flow restrictor may be positioned in the body between the gas pipe opening and the air inlet and an air flow smoothing insert may be positioned in the body upstream of the gas pipe opening. The device may further comprise a fan in fluid communication with the air/gas outlet. The fan may be configured to generate an under pressure at the air/gas outlet.

In another example, an air/gas admittance device for use with a combustion unit may comprise a body having a side wall defining a passageway that extends from an air inlet to an air/gas outlet and a gas pipe having a side wall defining a passageway that extends from a gas inlet to a gas outlet. The side wall of the body may have a gas pipe opening that is in fluid communication with the gas outlet of the gas pipe. A first pressure port may be in the side wall of the body, upstream of the gas pipe opening. A first pressure sensor may be operatively coupled to the first pressure port for measuring a pressure of air within the body. A second pressure port may be in the side wall of the gas pipe. A second pressure sensor may be operatively coupled to the second pressure port for measuring a pressure of gas within the gas pipe. An air flow smoothing insert may be positioned in the body upstream of the first pressure port. A gas control valve may be coupled to the gas inlet. A controller may be operatively coupled to the first pressure sensor, the second pressure sensor and the gas control valve. The controller may be configured to use the pressure of air within the body sensed by the first pressure sensor and the pressure of gas within the gas pipe sensed by the second pressure sensor to control the gas valve to produce a desired air/gas mixture at the air/gas outlet.

The preceding summary is provided to facilitate an understanding of some of the innovative features unique to the present disclosure and is not intended to be a full description. A full appreciation of the disclosure can be gained by taking the entire specification, claims, drawings, and abstract as a whole.

BRIEF DESCRIPTION OF THE DRAWINGS

The disclosure may be more completely understood in consideration of the following description of various illustrative embodiments in connection with the accompanying drawings, in which.

Figure 1:
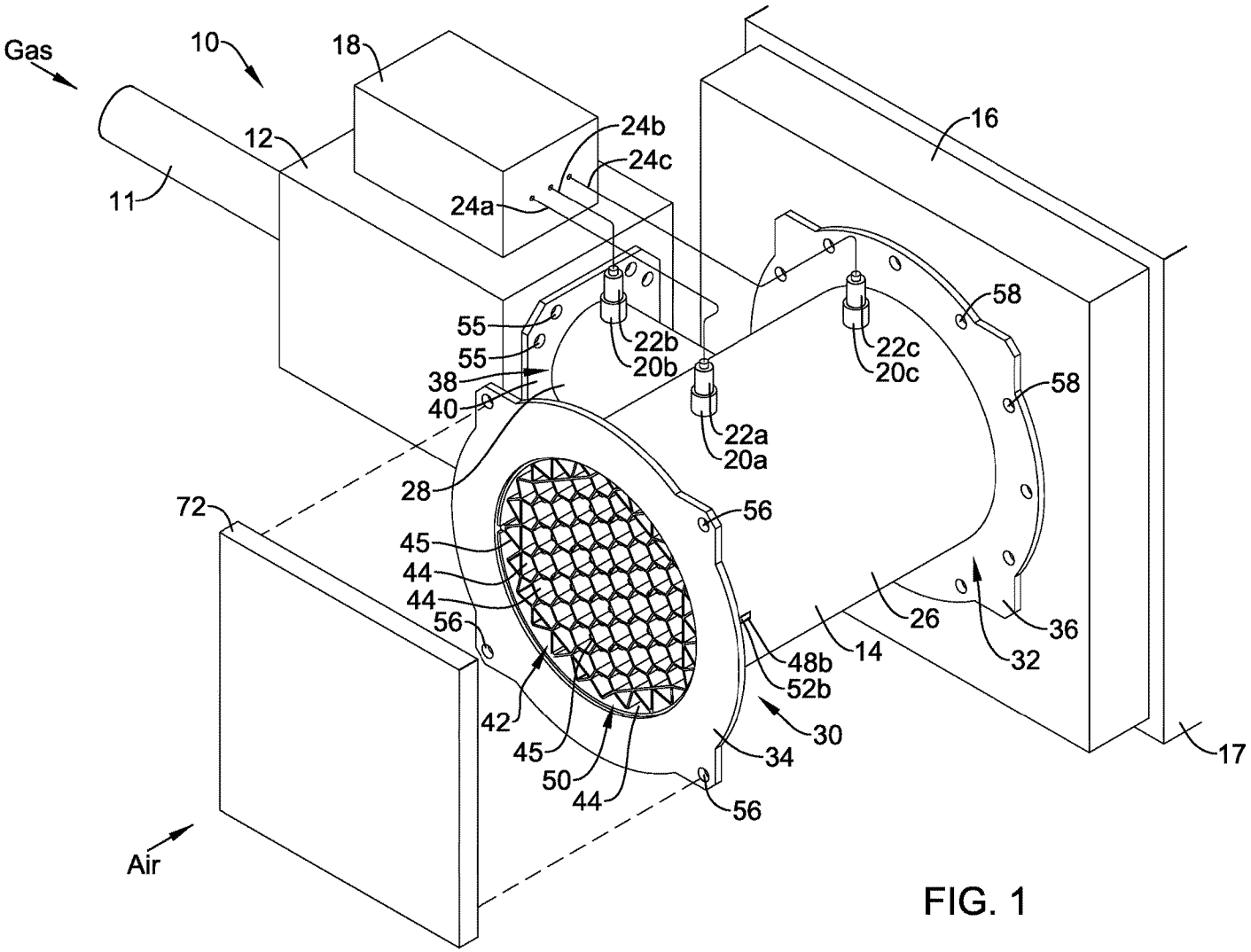
FIG. 1 is a schematic perspective view of an illustrative gas valve, air/gas admittance device and fan assembly for use with a combustion unit.

While the disclosure is amenable to various modifications and alternative forms, specifics thereof have been shown by way of example in the drawings and will be described in detail. It should be understood, however, that the intention is not to limit aspects of the disclosure to the particular illustrative embodiments described. On the contrary, the intention is to cover all modifications, equivalents, and alternatives falling within the spirit and scope of the disclosure.

DESCRIPTION

The following description should be read with reference to the drawings wherein like reference numerals indicate like elements throughout the several views. The description and drawings show several illustrative embodiments which are meant to be illustrative of the claimed disclosure.

Gas valves are often driven by electronic control systems which evaluate feedback signals from pressure and/or flow sensors. When pressure sensors are used, the pressure sensors may relay pressure readings to a controller which controls a position of the gas valve. The position of the gas valve may be adjusted to optimize the air to fuel (A/F) ratio in order to achieve low emissions of CO, NOx and/or to increase efficiency (e.g. save fuel). The pressure sensors may be placed to sense pressures before and/or after air and gas restrictors in an air/gas admittance device. Ideally, signals from the pressure signals are stable and largely free of oscillations and/or other noise caused by air or gas flow disturbances in the admittance device. Unstable pressure sensor signals can result in a non-uniform or otherwise non-optimal air/fuel ratio, which can reduce the efficiency and/or increase the emissions of the combustion unit. The air/gas admittance device described herein provides a more uniform gas and/or air flow, which reduces sensor noise and can improve the efficiency and/or emissions of a downstream combustion unit.

FIG. 1 is a schematic perspective view of an illustrative gas valve, air/gas admittance device and fan assembly for use with a combustion unit. The illustrative assembly 10 includes a gas valve assembly 12 for controlling gas flow to a combustion unit 17 or other similar or difference devices, an air/gas admittance device 14, a fan or blower 16, and a valve controller 18. While not explicitly shown, the gas valve assembly 12 may include a valve body that includes an inlet port coupled to a gas source 11, an outlet port configured to be coupled to a portion of the air/gas admittance device 14, and a fluid path or fluid channel extending between the inlet port and the outlet port. A valve member may control the flow of gas from the inlet port to the outlet port. Some illustrative gas valves are described in commonly assigned U.S. Patent Publication No. 2013/0153042 and U.S. Patent Publication No. 2013/0153041, which are herein incorporated by reference.

The gas valve assembly 12 may include one or more actuators to modulate the flow of gas that is provided to the air/gas admittance device 14. The valve controller 18 may control the gas valve assembly 12 based on signals from one or more pressure or flow sensors 22*a*-22*c* in order to provide a desired air/fuel ratio to the downstream fan or blower 16. In the example shown, the downstream fan or blower 16 mixes the air and gas streams and provides the mixed air/gas stream to a combustion chamber of the downstream combustion unit 17.

In the example shown, the gas valve assembly 12 is shown coupled to the air/gas admittance device 14. The air/gas admittance device 14 may be configured to provide air and gas (e.g. fuel) at a desired ratio to a downstream combustion unit 17. The illustrative air/gas admittance device 14 includes a body 26 having a side wall 78 defining a passageway 64 extending from an air inlet 50 to an air/gas outlet 62 (see, for example, FIG. 4). In some cases, the body 26 may have a generally tubular or cylindrical shape, although this is not required. The body 26 may include an air inlet flange 34 mounted adjacent to an air inlet, or first, end 30 thereof. The air inlet flange 34 may include one or more apertures 56 for receiving a fastening mechanism, including but not limited to bolts, screws, etc. The air inlet flange 34 may be configured to be connected (e.g. via apertures 56 and a fastening mechanism) to a structure 72 configured to control a flow of air, such as, but not limited to a valve, an air damper, or the like. For clarity, the air flow control structure 72 is shown uncoupled from the air inlet flange 34. A valve or damper can be closed to stop or prevent air flow when a combustion unit is not in use.

In some cases, the valve or damper 72 is not provided.

The body 26 of the air/gas admittance device 14 may also include an air/gas outlet flange 36 mounted adjacent to an air/gas outlet, or second, end 32 thereof. The air/gas outlet flange 36 may include one or more apertures 58 for receiving a fastening mechanism, including but not limited to a bolt, screw, etc. The air/gas outlet flange 36 may be configured to be connected (e.g. via apertures 58 and a fastening mechanism) to the fan or blower 16. In some cases, the air/gas outlet flange 36 may be directly coupled to a housing of the fan or blower 16. As the fan and/or blower 16 turns, the fan or blower 16 may generate an under pressure at the air/gas outlet 62 and/or in the passageway 64 of the air/gas admittance device 14, drawing air in through the air inlet 50 and gas inlet 68 and to the air/gas outlet 62, as will be described in more detail herein.

The air/gas admittance device 14 may include a gas pipe 28 extending generally orthogonal to the body 26. The gas pipe 28 may have a side wall 82 defining a passageway 66 extending from a gas inlet 68 to a gas pipe outlet 70 (see, for example, FIG. 4). In some cases, the gas pipe 28 may have a generally tubular or cylindrical shape, although this is not required. The gas pipe 28 may include a gas inlet flange 40 mounted adjacent to the gas inlet 68, or first, end 38 thereof. The gas inlet flange 40 may be configured to be connected to the body of the gas valve assembly 12. The gas inlet flange 40 may include one or more apertures 55 for receiving a fastening mechanism, including but not limited to bolts, screws, etc. The gas inlet flange 40 may be configured to be connected (e.g. via apertures 55 and a fastening mechanism) to the housing of the gas valve assembly 12. In some cases, the flow of gas may be drawn into the air/gas admittance device 14 aided by an under pressure created by the fan or blower 16.

The air/gas admittance device 14 may include a plurality of pressure ports formed in the side wall 78 of the body 26 and/or the side wall 82 of the gas pipe 28. In the example shown, the pressure ports may include a first pressure port 20*a*, a second pressure port 20*b*, and a third pressure port 20*c* (collectively, 20) extending through the side walls 78, 82 and into the passageways 64, 66. The pressure ports 20 may each be configured to receive or be operatively coupled with a pressure (or other) sensor 22*a*, 22*b*, 22*c* (collectively, 22). The pressure sensors 22 may be in operative communication with a fluid (e.g. air, gas, and/or an air/gas mixture) within the passageways 64, 66 to allow for pressure readings of the air, gas, and/or air/gas mixture to be obtained. The pressure sensors 22 may be in operative communication (e.g., through a wired 24*a*, 24*b*, 24*c* or wireless connection) to the valve controller 18. The pressure sensors 22 may provide pressure readings to the valve controller 18, which in turn may adjust a flow of gas from the gas valve assembly 12 to achieve a desired air/fuel ratio. More specifically, in order to achieve low emissions of CO, NOx and/or to increase efficiency (e.g. save fuel), the gas valve assembly 12 may be operated to control the air/fuel ratio (e.g. Lamba) of the mixed air stream provided to the combustion unit 17. In some applications, Lambda may be a function of the pressure amplification ratio. The pressure readings may be used to determine a pressure amplification ratio defined by the following equation:

$$P_{amp} = \frac{(P_{gas} - P_{Ref})}{(P_{air} - P_{Ref})}$$

where $P_{gas}$ is a pressure of the gas (e.g. obtained at pressure sensor 22*b*), $P_{air}$ is a pressure of the air (e.g. obtained at pressure sensor 22*a*), and $P_{Ref}$ is a reference pressure of an air/gas mixture (e.g. obtained at pressure sensor 22*c*). In order to maintain lambda (e.g. air/fuel ratio) at a desired (e.g. relatively constant) value, it is desirable to maintain the pressure amplification ratio ($P_{amp}$) at a constant value. In the example shown, the valve controller 18 may obtain pressure readings from the three pressure sensors (e.g. 22*a*, 22*b*, 22*c*) and determine a $P_{amp}$ value. The valve controller 18 may then adjust a position of the gas valve assembly 12 (and hence adjust a flow of gas to the gas inlet 68 of the air/gas admittance device 14) to maintain the $P_{amp}$ value essentially constant. For best performance and control, it is desirable for the pressure readings to be stable and free from oscillations and/or other noise caused by turbulent and/or non-uniform air and/or gas flows.

In some cases, an air flow smoothing insert 42 may be positioned within the passageway 64 of the body 26. Alternatively, or additionally, a gas flow smoothing insert (not shown), similar in form and function to the air flow smoothing insert 42 may be positioned within the passage way 82 of the gas pipe 28. The air flow smoothing insert 42 may be configured to filter and reduce or eliminate flow disturbances from the air entering the air/gas admittance device 14. This may result in a more stable flow uniformly spread over the whole air passageways 64. As a result, the pressure readings obtained at the pressure sensors 22 may be more stable and largely free from oscillations and/or other noise in a compact simple assembly.

The air flow smoothing insert 42 may include a plurality of openings 44 separated by a plurality of walls 45. In some cases, a portion of the openings 44 may have a generally hexagonal cross-sectional shape. In other words, the air flow smoothing insert 42 may have a generally honeycomb type configuration. However, it is contemplated that the openings 44 may have any cross-sectional shape desired, including, but not limited to, circular, oblong, square, rectangular, polygonal, etc.

Figure 2:
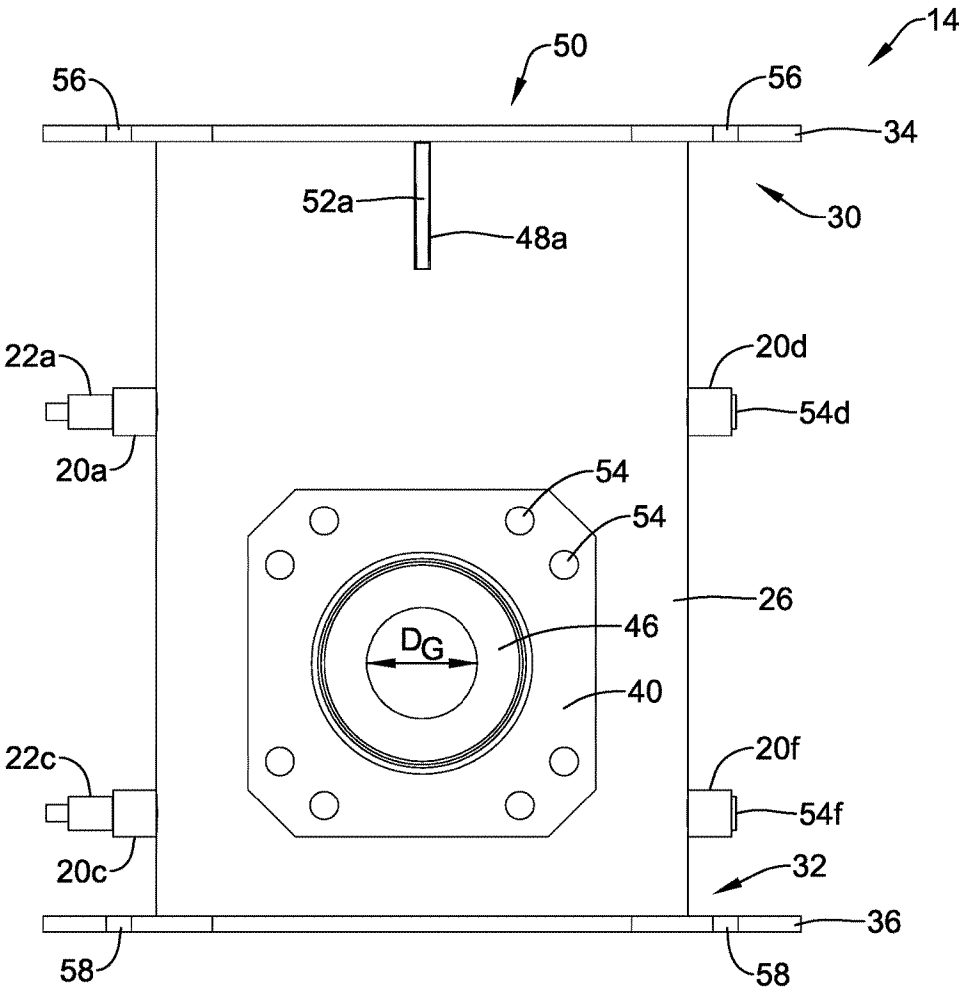
FIG. 2 is a schematic side view of the illustrative air/gas admittance device of FIG. 1.
Figure 4:
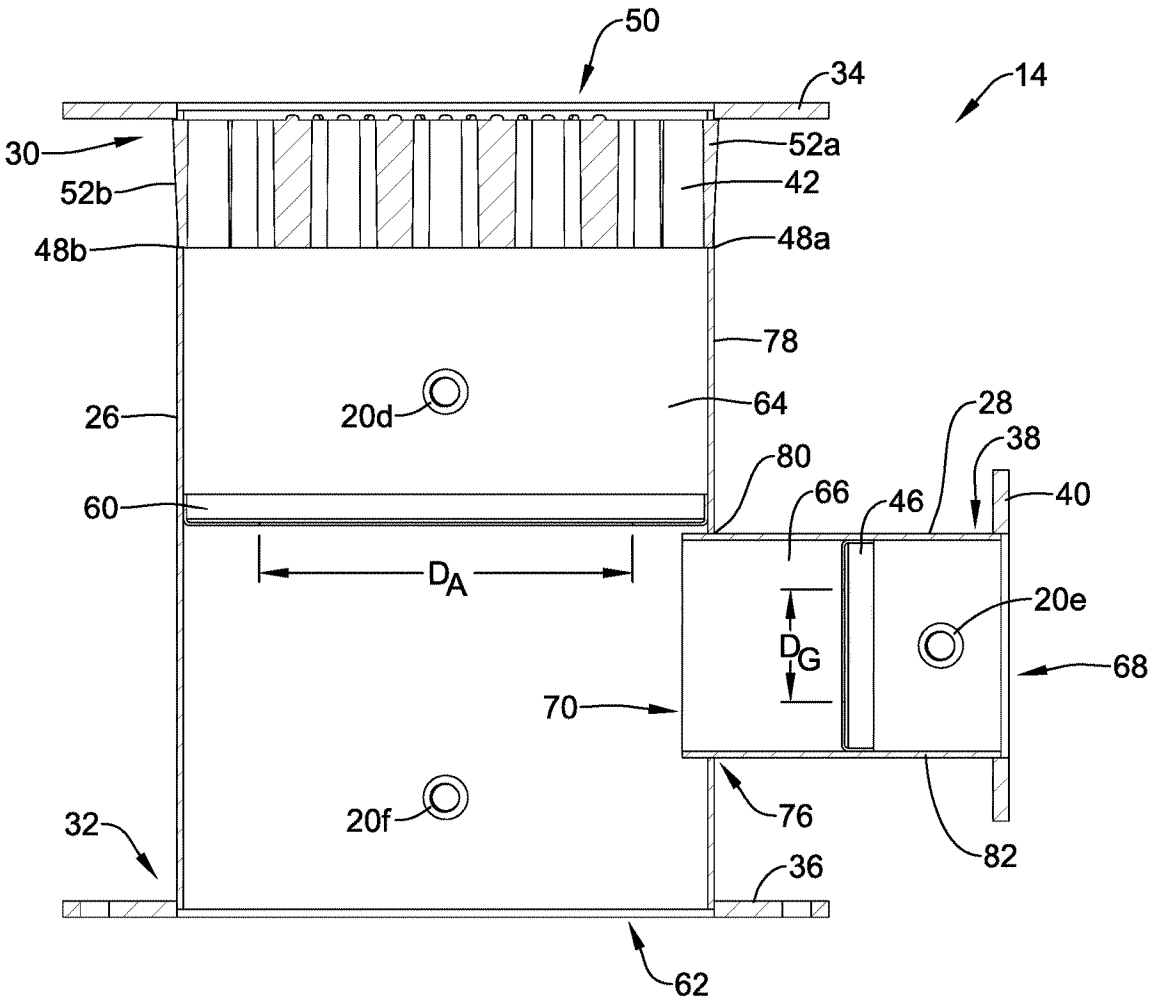
FIG. 4 is a cross-sectional view of the illustrative air/gas admittance device of FIG. 4, taken along line 4-4.

FIG. 2 is a side view of the illustrative air/gas admittance device 14 of FIG. 1. The air/gas admittance device 14 may include at least one slot or channel 48*a* in formed in the side wall 78 of the body 26. The channel 48*a* may be configured to slidably receive a portion 52*a* of the air flow smoothing insert 42. This may allow the air flow smoothing insert 42 to be removably positioned with the passageway 64 on an as-needed basis. In some cases, a second slot 48*b* may be provided opposite from the first slot 48*a*, as shown in FIG. 4. Additional slots may be provided as desired.

The body 26 of the air/gas admittance device 14 may include two (or more) additional pressure ports 20*d*, 20*f* formed in the side wall 78 of the body 26. The pressure ports 20*d*, 20*f* may be positioned generally opposite from or 180° from (e.g. opposing) the pressure ports 20*a*, 20*c* described above with respect to FIG. 1, although the pressure ports 20*d*, 20*f* can be oriented in any manner desired. The pressure ports 20*d*, 20*f* may each be configured to receive or be operatively coupled to a pressure or other sensor (not explicitly shown) It is contemplated that only the pressure ports 20 on one side of the air/gas admittance device 14 may be used in an application (e.g. pressure ports 20*a*, 20*c* or pressure ports 20*d*, 20*f*). The additional pressure ports 20*d*, 20*f* may be provided in the air/gas admittance device 14 to facilitate installation that block access to pressure ports 20*a*-20*c*. For example, the installer may utilize the pressure ports 20 that are easiest to access. The pressure ports 20 that do not receive a pressure sensor 22 may be blocked or plugged with a plug screw 54*d*, 54*f* or other removable mechanism. In some cases, only some of the pressure ports 20 will receive a pressure sensor 22.

In the example show, a gas flow restrictor 46 may be positioned within the passageway 66 of the gas pipe 28. The gas flow restrictor 46 may have a reduce diameter $D_G$ relative to the passageway 66. The diameter $D_G$ of the gas flow restrictor 46 may be precisely controlled to provide a predictable and consistent flow of gas into the body 26 of the air/gas admittance device 14 to aid in providing a constant and/or precise air/fuel ratio to the combustion unit. In some cases, the gas flow restrictor 46 may be removably positioned within the passageway 66. This may allow the gas flow restrictor 46 to be changed to accommodate different burner loads and/or different air/gas ratios. That is, different diameter $D_G$ gas flow restrictors 46 may be used in differing applications or configurations to provide a desired flow of gas to achieve a desired air/fuel ratio for a given combustion unit 17.

Figure 3:
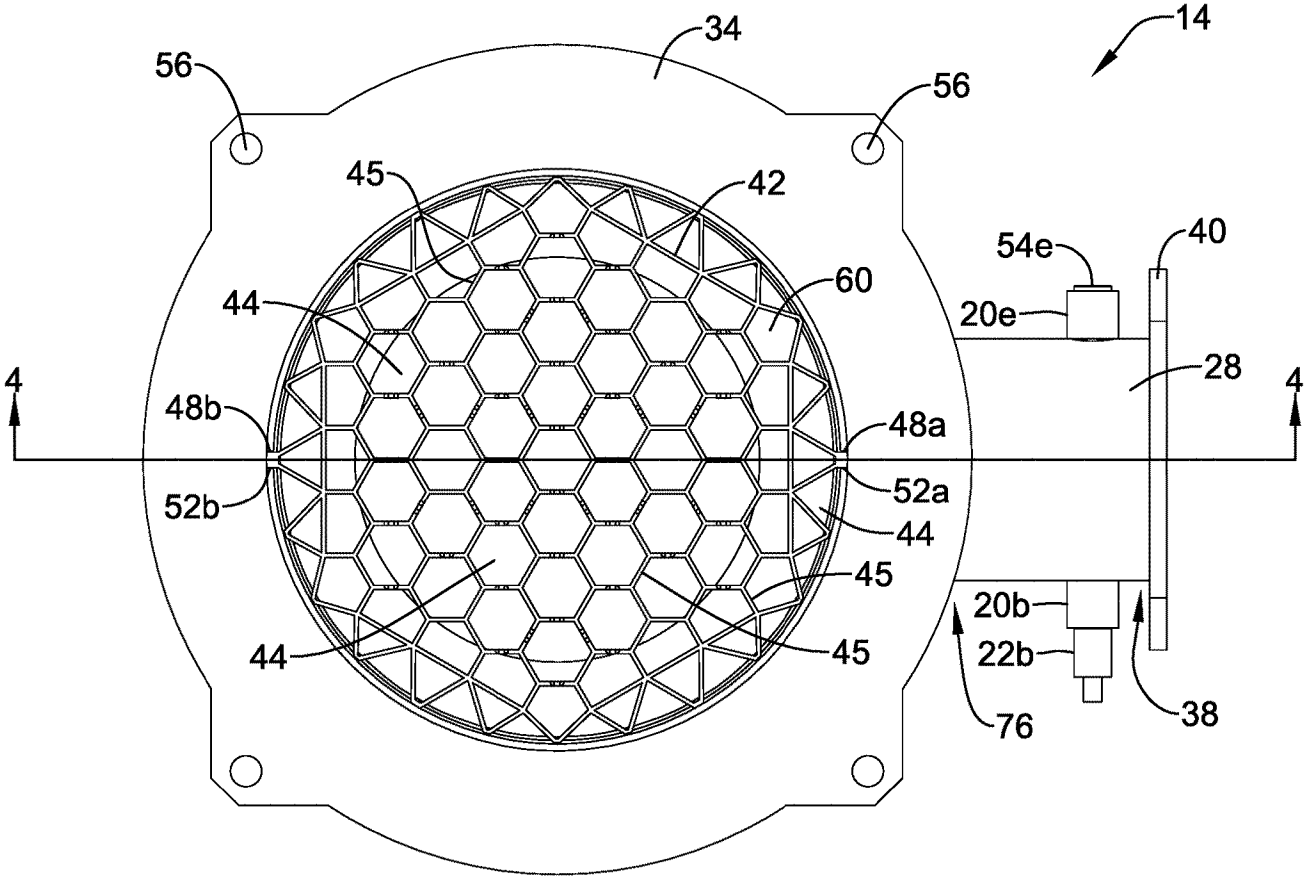
FIG. 3 is a schematic top view of the illustrative air/gas admittance device of FIG. 1.

FIG. 3 is a top view of the illustrative air/gas admittance device 14 of FIG. 1. As can be seen, the illustrative air flow smoothing insert 42 may include one or more regions or portions 52*a*, 52*b* that extend radially beyond the diameter of the air flow smoothing insert 42. These portions 52*a*, 52*b* may be configured to engage with corresponding channels 48*a*, 48*b* in the side wall 78 of the body 26. While not explicitly shown, the gas pipe 28 may similarly include slots or channels configured to receive a gas flow smoothing insert similar in form and function to the air flow smoothing insert 42, but this is not required.

The gas pipe 28 of the air/gas admittance device 14 may include an additional pressure ports 20*e* formed in the side wall 82 of the gas pipe 28. The pressure port 20*e* may be positioned generally opposite from or 180° from (e.g. opposing) the pressure port 20*b* shown in FIG. 1, although the pressure port 20*e*, can be oriented in any manner desired. The pressure port 20*e* may be configured to receive or be operatively coupled to a pressure sensor (not explicitly shown). It is contemplated that only the pressure ports 20 on one side of the air/gas admittance device 14 may be used in an application (e.g. pressure port 20*b* or pressure port 20*e*). The additional pressure port 20*e* may be provided in the air/gas admittance device 14 to facilitate installation. For example, the installer may utilize the pressure ports 20 that are easiest to access. The pressure ports 20 that do not receive a pressure sensor 22 may be blocked or plugged with a plug screw 54*e* or other removable mechanism. It is contemplated that only some of the pressure ports 20 will receive a pressure sensor 22. For example, only one of the air pressure ports 20*a* or 20*d*, one of the gas pressure ports 20*b* or 20*e*, and one of the mixed (or reference) pressure ports 20*c* or 20*f* may receive a pressure sensor 22. The remaining pressure ports (e.g. without a pressure sensor 22) will be provided with a plug screw 54 or the like.

FIG. 4 is a cross-section of the illustrative air/gas admittance device 14 taken at line 4-4 of FIG. 3. In the example shown, an air flow restrictor 60 may be positioned within the air passageway 64 of the body 26. The air flow restrictor 60 may have a reduce diameter $D_A$ relative to the air passageway 64. The diameter $D_A$ of the air flow restrictor 60 and the diameter $D_G$ of the gas flow restrictor 46 may be precisely controlled to help provide a predictable and consistent air/fuel ratio to the combustion unit 17. In some cases, the air flow restrictor 60 may be removably positioned within the passageway 64. This may allow the air flow restrictor 60 to be easily changed to accommodate different combustion units. In other words, different diameter $D_A$ air flow restrictors 60 and/or different diameter $D_G$ gas flow restrictors 46 may be used in differing applications or configurations to provide a controlled air/fuel volumetric rate and air/fuel ratio to support a given combustion unit 17.

The body 26 of the air/gas admittance device 14 may include an opening 80 extending through the side wall 78 thereof. The opening 80 may be downstream of the air flow restrictor 60 and upstream of the reference pressure port 20*c*, 20*f* A second end 76 of the gas pipe 28 may be secured to the side wall 78 of the body 26 such that the gas pipe outlet 70 (and passageway 66) is in fluid communication with the opening 80 and the passageway 64 of the body 26.

The gas flow restrictor 46 may be positioned with the gas pipe 28 (e.g. within the passageway 66) downstream of the gas inlet 68 and upstream the gas pipe outlet 70. In the example shown, the gas flow restrictor 46 may also be positioned downstream of the gas pressure port 20*b*, 20*e*. This may allow a gas pressure reading to be obtained upstream of the gas flow restrictor 46 and prior to the gas mixing with air.

The air flow restrictor 60 may be positioned downstream of the air inlet 50 and upstream of the opening 80 (and/or gas pipe outlet 70) in the side wall 78. In the example shown, the air pressure port 20*a*, 20*d* may be positioned between the air flow smoothing insert 42 and the air flow restrictor 60 to obtain an air pressure reading upstream of the air flow restrictor 60 and prior to mixing with gas. As such, the air pressure port 20*a*, 20*d* may be positioned upstream of the air flow restrictor 60 and upstream of the opening 80 (and/or gas pipe outlet 70) in the side wall 78.

As shown in FIG. 4, the air flow smoothing insert 42 may be positioned upstream of the air flow restrictor 60 and the air pressure port 20*a*, 20*d*. This may allow the flow of air to be smoothed (e.g. turbulence reduced from the incoming air flow) prior to obtaining a pressure reading and prior to passing through the air flow restrictor 60. While the air flow smoothing insert 42 is illustrated as generally adjacent to the air inlet 50, the air flow smoothing insert 42 may be positioned at any location between the air inlet 50 and the air pressure ports 20*a*, 20*d*. Likewise, when provided, a gas flow smoothing insert may be positioned upstream of the gas flow restrictor 46 and the gas pressure port 20*b*, 20*e*. This may allow the flow of gas to be smoothed (e.g. turbulence reduced from the incoming gas) prior to obtaining a pressure reading and prior to passing through the gas flow restrictor 46. A gas flow smoothing insert may be positioned at any location between the gas inlet 68 and the gas pressure ports 20*b*, 20*e*.

The reference pressure port 20*c* and opposing reference pressure port 20*f*, it is contemplated that these pressure ports may be positioned between the opening 80 (and/or gas pipe outlet 70) and the air/gas or mixed outlet 62 of the body 26 to obtain a pressure reading of the mixed gas and air. In other words, the reference pressure ports 20*c*, 20*f* may be positioned downstream of the gas pipe outlet 70. While the air and gas are referred to as mixed within the downstream portion of the air/gas admittance device 14, it should be noted that the gas and air may not be completely mixed. Further mixing of the air and gas may occur in downstream components, such as, but not limited to the fan or blower 16.

Figure 5:
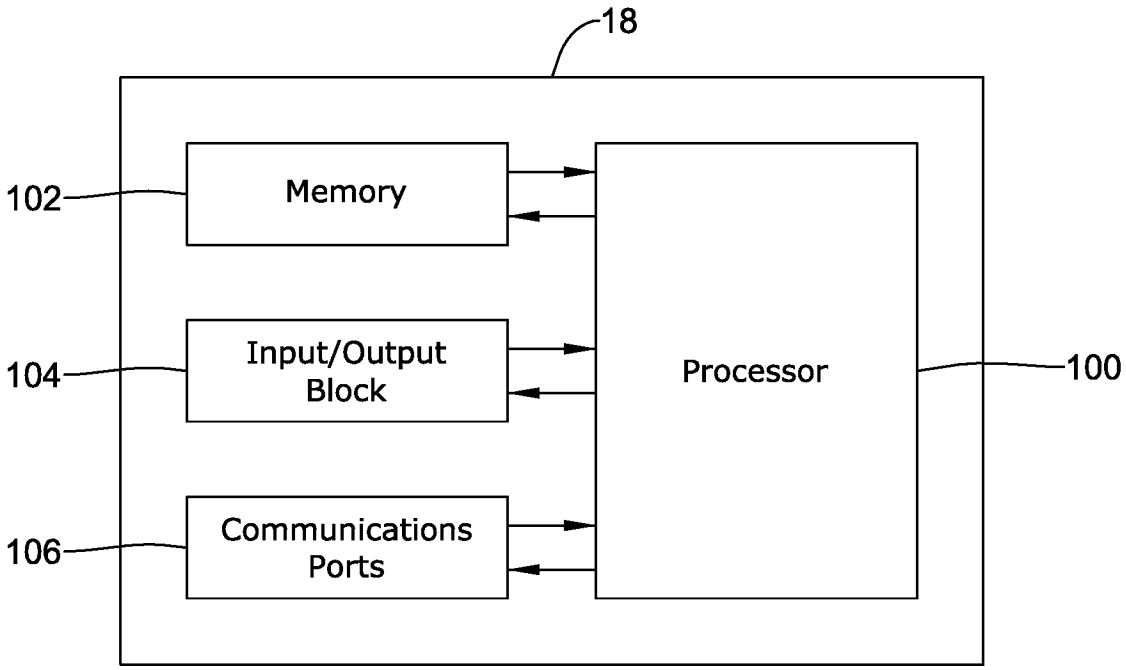
FIG. 5 is a schematic block diagram of an illustrative valve controller for controlling the gas valve of FIG. 1.

FIG. 5 is a schematic block diagram of an illustrative valve controller 18 that may be used with the present assembly 10. The illustrative valve controller 18 includes a processor or controller 100. The valve controller 18 may be adapted or configured to operate in accordance with an algorithm that controls or at least partially controls portions of the gas valve assembly 12. The valve controller 18 may include a memory block 102 that may be considered as being electrically connected to the processor 100. The memory block 102 may be used to store any desired information, such as the aforementioned control algorithm, set points, A/F ratio versus burner load curves, and the like. The processor 100 may store information within memory block 102 and may subsequently retrieved the stored information. The memory block 102 may be any suitable type of storage device, such as RAM, ROM, EPROM, a flash drive, a hard drive, and the like.

In many cases, the valve controller 18 may include an input/output block (I/O block) 104 having a number of wire terminals for receiving one or more wires from the gas valve assembly 12, the pressure sensors 22*a*-22*c* of the air/gas admittance device 14, and/or the combustion unit 17. While the term I/O may imply both input and output, it is intended to include input only, output only, as well as both input and output. The I/O block 104 may be used to communicate one or more signals to and/or from the gas valve assembly 12, air/gas admittance device 14, and/or combustion unit. The valve controller 18 may have any number of wire terminals for accepting connections from the gas valve assembly 12, air/gas admittance device 14, and/or combustion unit 17. How many and which of the wire terminals are actually used at a particular installation may depend on the particular configuration of the gas valve assembly 12, air/gas admittance device 14 and/or combustion unit 17.

In some cases, as illustrated, the valve controller 18 may include a communications or data port 106. The communication ports 106 may be configured to communicate with the processor 100 and may, if desired, be used to either upload information to the processor 100, download information from the processor 100, provide commands to the processor 100, send commands from the processor 100, and/or perform any other suitable task. The communication port 106 may be a wireless port such as a Bluetooth™ port or any other wireless protocol. In some cases, communication port 106 may be a wired port such as a serial port, a parallel port, a CAT5 port, a USB (universal serial bus) port, or the like. In some instances, the communication port 106 may be a USB port and may be used to download and/or upload information from a USB flash drive. Other storage devices may also be employed, as desired. In some cases, a separate device may be in communication with the processor 100 of the valve controller 18.

As noted above, the valve controller 18 may be in wired or wireless communication with an external device. The external device may be a computing device separate from the gas valve assembly 12. For example, the external device may be a personal computer, tablet computer, smart phone, laptop computer, a server, or other computer as desired. In some cases, the external device may not be a part of the gas valve assembly 12 or combustion unit 17. For example, the external device may be a portable device which travels with an installer.

Figure 6:
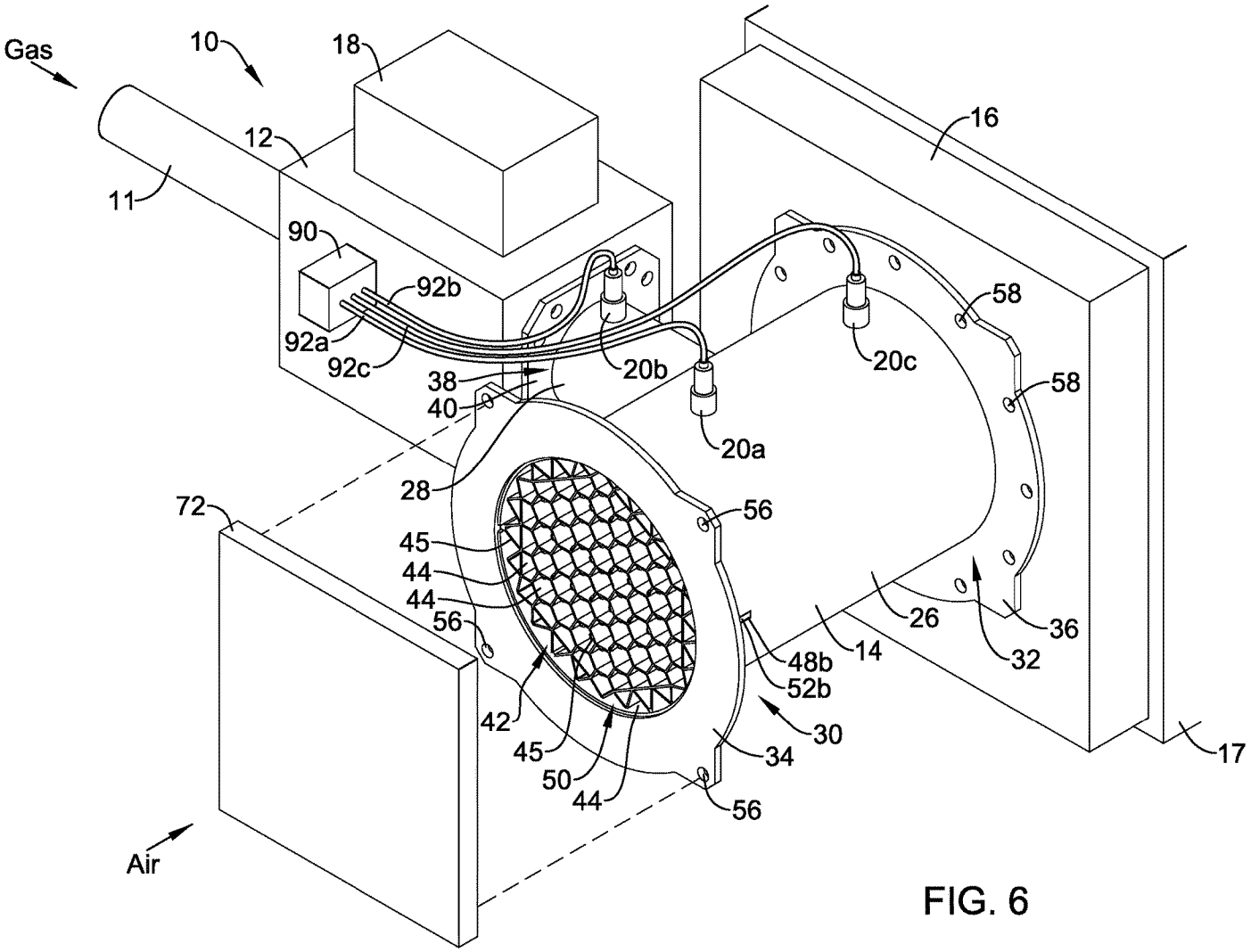
FIG. 6 is a schematic perspective view of another illustrative gas valve, air/gas admittance device and fan assembly for use with a combustion unit.

FIG. 6 is another schematic perspective view of an illustrative gas valve, air/gas admittance device and fan assembly 10 for use with a combustion unit with an alternative pressure sensor connection. The assembly 10 may be substantially similar in form and function to the assembly 10 as described with respect to FIGS. 1-5. It should be understood that like numbers represent like parts. In the example shown in FIG. 6, pressure sensors may be positioned within a box 90 coupled to the valve body of the valve assembly 12. The pressure sensors may be fluidly coupled or operatively coupled to the pressure ports 20 via conduits or tubes 92*a*, 92*b*, 92*c* (collectively, 92). As such, the pressure sensors may be in operative communication with a fluid (e.g. air, gas, and/or an air/gas mixture) within the passageways 64, 66 to allow for pressure readings of the air, gas, and/or air/gas mixture to be obtained. As described above, in some cases, only a portion of the pressure ports 20 may be operatively coupled to a pressure sensor. The remaining (e.g. without tubes 92) pressure ports 20 may be plugged or otherwise blocked. The pressure sensors may also be in operative communication (e.g., through a wired or wireless connection) to the valve controller 18.

EXAMPLES

In a first example, an illustrative air/gas admittance device for use with a combustion unit may comprise a body having a side wall defining a passageway that extends from an air inlet to an air/gas outlet and a gas pipe having a side wall defining a passageway that extends from a gas inlet to a gas outlet. The side wall of the body may have a gas pipe opening that is in fluid communication with the gas outlet of the gas pipe. An air flow restrictor may be positioned in the body between the gas pipe opening and the air inlet and a gas flow restrictor may be positioned in the gas pipe downstream of the gas inlet. A first pressure port may be in the side wall of the body, upstream of the gas pipe opening. The first pressure port may be configured to be operatively coupled to a first pressure sensor for measuring a pressure of air within the body. A second pressure port may be in the side wall of the gas pipe. The second pressure port may be configured to be operatively coupled to a second pressure sensor for measuring a pressure of gas within the gas pipe. An air flow smoothing insert may be positioned in the body upstream of the first pressure port.

Alternatively or additionally to any of the examples above, in another example, the air/gas admittance device may further comprise a third pressure port in the side wall of the body downstream of the gas pipe opening. The third pressure port may be configured to be operatively coupled to a third pressure sensor for measuring a pressure adjacent the air/gas outlet.

Alternatively or additionally to any of the examples above, in another example, the first pressure port may be positioned upstream of the air flow restrictor, and the second pressure port may be positioned upstream of the gas flow restrictor.

Alternatively or additionally to any of the examples above, in another example, the air/gas admittance device may further comprise an outlet flange mounted to the body adjacent to the air/gas outlet.

Alternatively or additionally to any of the examples above, in another example, the air/gas admittance device may further comprise a fan mounted to the outlet flange for creating an under pressure at the air/gas outlet of the body.

Alternatively or additionally to any of the examples above, in another example, the air/gas admittance device may further comprise a fourth pressure port in the side wall of the body, upstream of the gas pipe opening and opposing the first pressure port and a fifth pressure port in the side wall of the gas pipe and opposing the second pressure port.

Alternatively or additionally to any of the examples above, in another example, the air/gas admittance device may further comprise a sixth pressure port in the side wall of the body, downstream of the gas pipe opening and opposing the third pressure port.

Alternatively or additionally to any of the examples above, in another example, the air/gas admittance device may further comprise an air inlet flange coupled to the body adjacent to the air inlet.

Alternatively or additionally to any of the examples above, in another example, the air/gas admittance device may further comprise an air damper coupled to the air inlet flange.

Alternatively or additionally to any of the examples above, in another example, the air/gas admittance device may further comprise a gas inlet flange coupled to the gas pipe adjacent to the gas inlet.

Alternatively or additionally to any of the examples above, in another example, the air/gas admittance device may further comprise a gas valve coupled to the gas inlet flange.

Alternatively or additionally to any of the examples above, in another example, the air flow smoothing insert may be positioned upstream of the air flow restrictor.

Alternatively or additionally to any of the examples above, in another example, the air/gas admittance device may further comprise a gas flow smoothing insert positioned upstream of the second pressure port.

In another example, an air/gas admittance device for use with a combustion unit may comprise a body having a side wall defining a passageway that extends from an air inlet to an air/gas outlet and a gas pipe having a side wall defining a passageway that extends from a gas inlet to a gas outlet. The side wall of the body may have a gas pipe opening that is in fluid communication with the gas outlet of the gas pipe. An air flow restrictor may be positioned in the body between the gas pipe opening and the air inlet and an air flow smoothing insert may be positioned in the body upstream of the gas pipe opening. The device may further comprise a fan in fluid communication with the air/gas outlet. The fan may be configured to generate an under pressure at the air/gas outlet.

Alternatively or additionally to any of the examples above, in another example, the air/gas admittance device may further comprise a first pressure port in the side wall of the body, upstream of the gas pipe opening. The first pressure port may be configured to be operatively coupled to a first pressure sensor for measuring a pressure of air within the body. The air/gas admittance device may further comprise a second pressure port in the side wall of the gas pipe. The second pressure port may be configured to be operatively coupled to a second pressure sensor for measuring a pressure of gas within the gas pipe.

Alternatively or additionally to any of the examples above, in another example, the air/gas admittance device may further comprise a third pressure port in the side wall of the body downstream of the gas pipe opening. The third pressure port may be configured to be operatively coupled to a third pressure sensor for measuring a pressure adjacent the air/gas outlet.

Alternatively or additionally to any of the examples above, in another example, the air/gas admittance device may further comprise an outlet flange mounted to the body adjacent to the air/gas outlet, and wherein the fan is mounted directly to the outlet flange.

Alternatively or additionally to any of the examples above, in another example, the air/gas admittance device may further comprise a gas inlet flange coupled to the gas pipe adjacent to the gas inlet and a gas valve mounted directly to the gas inlet flange.

In another example, an air/gas admittance device for use with a combustion unit may comprise a body having a side wall defining a passageway that extends from an air inlet to an air/gas outlet and a gas pipe having a side wall defining a passageway that extends from a gas inlet to a gas outlet. The side wall of the body may have a gas pipe opening that is in fluid communication with the gas outlet of the gas pipe. A first pressure port may be in the side wall of the body, upstream of the gas pipe opening. A first pressure sensor may be operatively coupled to the first pressure port for measuring a pressure of air within the body. A second pressure port may be in the side wall of the gas pipe. A second pressure sensor may be operatively coupled to the second pressure port for measuring a pressure of gas within the gas pipe. An air flow smoothing insert may be positioned in the body upstream of the first pressure port. A gas control valve may be coupled to the gas inlet. A controller may be operatively coupled to the first pressure sensor, the second pressure sensor and the gas control valve. The controller may be configured to use the pressure of air within the body sensed by the first pressure sensor and the pressure of gas within the gas pipe sensed by the second pressure sensor to control the gas valve to produce a desired air/gas mixture at the air/gas outlet.

Alternatively or additionally to any of the examples above, in another example, the air/gas admittance device may further comprising a third pressure port in the side wall of the body downstream of the gas pipe opening and a third pressure sensor operatively coupled to the third pressure port for measuring a pressure adjacent the air/gas outlet. The controller may be configured to use the pressure of air within the body sensed by the first pressure sensor, the pressure of gas within the gas pipe sensed by the second pressure sensor, and the pressure adjacent the air/gas outlet sensed by the third pressure sensor to control the gas valve to produce a desired air/gas mixture at the air/gas outlet.

It should be understood that this disclosure is, in many respects, only illustrative. The various individual elements discussed above may be arranged or configured in any combination thereof without exceeding the scope of the disclosure. Changes may be made in details, particularly in matters of shape, size, and arrangement of steps without exceeding the scope of the disclosure. The disclosure's scope is, of course, defined in the language in which the appended claims are expressed.

What is claimed is:

1. An air/gas admittance device for use with a combustion unit, the air/gas admittance device comprising:

a body having a side wall defining a passageway that extends from an air inlet to an air/gas outlet;

a gas pipe having a side wall defining a passageway that extends from a gas inlet to a gas outlet;

the side wall of the body having a gas pipe opening that is in fluid communication with the gas outlet of the gas pipe;

an air flow restrictor positioned in the body between the gas pipe opening and the air inlet;

a gas flow restrictor positioned in the gas pipe downstream of the gas inlet;

a first pressure port in the side wall of the body, upstream of the gas pipe opening, the first pressure port configured to be operatively coupled to a first pressure sensor for measuring a pressure of air within the body;

a second pressure port in the side wall of the gas pipe, the second pressure port configured to be operatively coupled to a second pressure sensor for measuring a pressure of gas within the gas pipe; and an air flow smoothing insert positioned in the body upstream of the first pressure port.

2. The air/gas admittance device of claim 1, further comprising a third pressure port in the side wall of the body downstream of the gas pipe opening, the third pressure port configured to be operatively coupled to a third pressure sensor for measuring a pressure adjacent the air/gas outlet.

3. The air/gas admittance device of claim 2, further comprising:

a fourth pressure port in the side wall of the body, upstream of the gas pipe opening and opposing the first pressure port; and a fifth pressure port in the side wall of the gas pipe and opposing the second pressure port.

4. The air/gas admittance device of claim 3, further comprising a sixth pressure port in the side wall of the body, downstream of the gas pipe opening and opposing the third pressure port.

5. The air/gas admittance device of claim 1, wherein the first pressure port is positioned upstream of the air flow restrictor, and the second pressure port is positioned upstream of the gas flow restrictor.

6. The air/gas admittance device of claim 1, further comprising an outlet flange mounted to the body adjacent to the air/gas outlet.

7. The air/gas admittance device of claim 6, further comprising a fan mounted to the outlet flange for creating an under pressure at the air/gas outlet of the body.

8. The air/gas admittance device of claim 1, further comprising an air inlet flange coupled to the body adjacent to the air inlet.

9. The air/gas admittance device of claim 8, further comprising an air damper coupled to the air inlet flange.

10. The air/gas admittance device of claim 1, further comprising a gas inlet flange coupled to the gas pipe adjacent to the gas inlet.

11. The air/gas admittance device of claim 10, further comprising a gas valve coupled to the gas inlet flange.

12. The air/gas admittance device of claim 1, wherein the air flow smoothing insert is positioned upstream of the air flow restrictor.

13. The air/gas admittance device of claim 1, further comprising a gas flow smoothing insert positioned upstream of the second pressure port.

14. An air/gas admittance device for use with a combustion unit, the air/gas admittance device comprising:

a body having a side wall defining a passageway that extends from an air inlet to an air/gas outlet;

a gas pipe having a side wall defining a passageway that extends from a gas inlet to a gas outlet;

the side wall of the body having a gas pipe opening that is in fluid communication with the gas outlet of the gas pipe;

an air flow restrictor positioned in the body between the gas pipe opening and the air inlet;

an air flow smoothing insert positioned in the body upstream of the gas pipe opening; and a fan in fluid communication with the air/gas outlet, the fan configured to generate an under pressure at the air/gas outlet.

15. The air/gas admittance device of claim 14, further comprising:

a first pressure port in the side wall of the body, upstream of the gas pipe opening, the first pressure port configured to be operatively coupled to a first pressure sensor for measuring a pressure of air within the body; and a second pressure port in the side wall of the gas pipe, the second pressure port configured to be operatively coupled to a second pressure sensor for measuring a pressure of gas within the gas pipe.

16. The air/gas admittance device of claim 15, further comprising a third pressure port in the side wall of the body downstream of the gas pipe opening, the third pressure port configured to be operatively coupled to a third pressure sensor for measuring a pressure adjacent the air/gas outlet.

17. The air/gas admittance device of claim 14, further comprising an outlet flange mounted to the body adjacent to the air/gas outlet, and wherein the fan is mounted directly to the outlet flange.

18. The air/gas admittance device of claim 14, further comprising:

a gas inlet flange coupled to the gas pipe adjacent to the gas inlet; and a gas valve mounted directly to the gas inlet flange.

19. An air/gas admittance device for use with a combustion unit, the air/gas admittance device comprising:

a body having a side wall defining a passageway that extends from an air inlet to an air/gas outlet;

a gas pipe having a side wall defining a passageway that extends from a gas inlet to a gas outlet;

the side wall of the body having a gas pipe opening that is in fluid communication with the gas outlet of the gas pipe;

a first pressure port in the side wall of the body, upstream of the gas pipe opening;

a first pressure sensor operatively coupled to the first pressure port for measuring a pressure of air within the body;

a second pressure port in the side wall of the gas pipe;

a second pressure sensor operatively coupled to the second pressure port for measuring a pressure of gas within the gas pipe;

an air flow smoothing insert positioned in the body upstream of the first pressure port;

a gas control valve coupled to the gas inlet; and a controller operatively coupled to the first pressure sensor, the second pressure sensor and the gas control valve, the controller is configured to use the pressure of air within the body sensed by the first pressure sensor and the pressure of gas within the gas pipe sensed by the second pressure sensor to control the gas valve to produce a desired air/gas mixture at the air/gas outlet.

20. The air/gas admittance device of claim 19, further comprising:

a third pressure port in the side wall of the body downstream of the gas pipe opening;

a third pressure sensor operatively coupled to the third pressure port for measuring a pressure adjacent the air/gas outlet; and wherein the controller is configured to use the pressure of air within the body sensed by the first pressure sensor, the pressure of gas within the gas pipe sensed by the second pressure sensor, and the pressure adjacent the air/gas outlet sensed by the third pressure sensor to control the gas valve to produce a desired air/gas mixture at the air/gas outlet.

* * * * *